US005198273A

United States Patent [19]

Ando et al.

[11] Patent Number: 5,198,273

[45] Date of Patent: Mar. 30, 1993

[54] ELECTROLESS GOLD PLATING SOLUTION AND METHOD FOR PLATING GOLD THEREWITH

[75] Inventors: Setsuo Ando, Kawasaki; Jiro Ushio, Yokohama; Takashi Inoue, Yokohama; Hiroaki Okudaira, Yokohama; Takeshi Shimazaki, Hitachi; Hitoshi Yokono, Fujisawa, all of Japan

[73] Assignees: Hitachi, Ltd.; Hitachi Chemical Company, Ltd., both of Tokyo, Japan

[21] Appl. No.: 580,877

[22] Filed: Sep. 11, 1990

[30] Foreign Application Priority Data

Sep. 18, 1989 [JP] Japan ..... 1-240229

[51] Int. Cl.[5] ..... C23C 26/00

[52] U.S. Cl. ..... 427/437; 427/304; 427/305; 427/306; 427/443.1

[58] Field of Search ..... 427/443.1, 306, 304, 427/305, 437

[56] References Cited

U.S. PATENT DOCUMENTS

| | | | |
|---|---|---|---|
| 3,300,328 | 1/1967 | Luce | 427/437 |
| 3,506,462 | 4/1970 | Oda | 106/1.22 |
| 3,700,469 | 10/1972 | Okinaka | 427/437 |
| 4,066,804 | 1/1978 | Andrews | 427/306 |
| 4,181,750 | 1/1980 | Beckenbaugh | 427/306 |
| 4,181,759 | 1/1980 | Feldstein | 427/437 |
| 4,307,136 | 12/1981 | Prost-Tournier | 427/437 |
| 4,352,690 | 10/1982 | Dettke | 427/437 |
| 4,804,559 | 2/1989 | Ushio | 427/98 |
| 4,880,464 | 11/1989 | Ushio | 106/1.26 |
| 4,963,974 | 10/1990 | Ushio | 174/250 |

FOREIGN PATENT DOCUMENTS

| | | | |
|---|---|---|---|
| 219788 | 4/1987 | European Pat. Off. | 427/304 |
| 2841584 | 4/1980 | Fed. Rep. of Germany | 427/443.1 |
| 141875 | 7/1985 | Japan | 427/437 |
| 3250469 | 10/1988 | Japan | 427/437 |
| 1027652 | 4/1966 | United Kingdom | 427/437 |

OTHER PUBLICATIONS

"Science for Electroplaters", Metal Finishing, Aug. 1966, pp. 73, 74, 76.

European Search Report, dated 14 Jun. 1991.

Patent Abstracts of Japan, vol. 13, No. 466 (C-646) [3814], 20th Oct. 1989; & JP-A-1 180 985 (Hitachi).

*Primary Examiner*—Michael Lusignan

*Assistant Examiner*—Vi Duong Dang

*Attorney, Agent, or Firm*—Antonelli, Terry, Stout & Kraus

[57] ABSTRACT

The present invention provides an electroless gold plating solution comprising essentially gold ions, a complexing agent, and a reducing agent, characterized by further containing a reduction promoter which has a function of giving electrons to an oxidant, the oxidant being produced from oxidation of the reducing agent with the gold ions being reduced, to change the oxidant to the original reducing agent. The present invention also provides a process for conducting electroless gold plating by bringing a substrate into contact with the electroless gold plating solution. The plating solution is excellent in the stability for gold plating of high deposition rate. Thus the present invention allows the electroless gold plating to be performed stably at a higher deposition rate.

14 Claims, 9 Drawing Sheets

FORMAMIDINE SULFINIC ACID (h)
(SOLUTION DISSOCIATION PROMOTING PRODUCT)

ELECTROLESS GOLD PLATING SOLUTION AND METHOD FOR PLATING GOLD THEREWITH

BACKGROUND OF THE INVENTION

The present invention relates to an electroless gold plating solution and a method for plating gold using the same.

The conventional electroless gold plating solutions are composed primarily of potassium gold (I) cyanide, potassium cyanide and a borane-based compound as reducing agent as described, for example, in Plating, Vol. 57 (1970), pp. 914–920. This process can produce a plating solution capable of exhibiting a plating rate of 1 μm/hr. U.S. Pat. No. 3,506,462 discloses those composed of potassium gold (I) cyanide and thiourea as a reducing agent.

On the other hand, Japanese Patent Publication No. 56-20353 discloses a cyanide ion-free electroless gold plating solution comprising primarily chloroaurate (III) and hydrazine as a reducing agent.

The prior techniques as described above have caused problems that as the reducing agents are consumed, the reaction products thereof are accumulated to inhibit the plating reaction, and that the stability of the solution is significantly reduced due to the reduction reactions of gold ions with the reaction products in the solution.

SUMMARY OF THE INVENTION

It is an object of the present invention to provide an electroless gold plating method which is excellent in stability to cause no accumulation of reaction products capable of reducing gold ions in the solution because of the recycling of a reducing agent, and allows the plating to proceed at a higher speed than does the prior art.

The above object can be achieved by using an electroless gold plating solution at least comprising gold ions, a complexing agent and a reducing agent to reduce the gold ions, and further containing a reduction promoter which has a function of giving electrons to and reducing an oxidant which has been produced from oxidation of the reducing agent to change the oxidant to the reducing agent, thus the reduction promoter inhibits the formation of harmful reaction products which reduce the gold ions in the plating solution.

The aforementioned reduction promoter should be a phenyl compound represented by the following general formula:

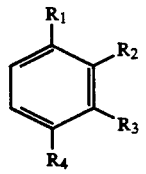

where $R_1$ represents either a hydroxyl group or an amino group, and each of $R_2$, $R_3$, and $R_4$ represents independently one group selected from hydroxyl, amino, hydrogen, halogen, methoxy, and alkyl groups.

The alkyl groups should be of an enough less number of carbon atoms to be soluble in water, and preferred alkyl groups are practically selected from those having 1 to 4 carbon atoms, such as methyl, ethyl and t-butyl groups.

When $R_1$ represents a hydroxyl group, the general formula as above represents phenol compounds. The phenol compounds should be practically selected from the group consisting of, for example, phenol, o-cresol, p-cresol, o-ethyl phenol, p-ethyl phenol, t-butyl phenol, o-amino phenol, p-amino phenol, hydroquinone, catechol, pyrogallol, methyl hydroquinone, chlorohydroquinone, and methoxy hydroquinone.

When $R_1$ represents an amino group, the general formula represents aromatic amine compounds. The amine compounds should be practically selected from the group consisting of, for example, aniline, o-phenylenediamine, p-phenylenediamine, o-toluidine, p-toluidine, o-ethylaniline, and p-ethylaniline.

Of these reduction promoters, hydroquinone and pyrogallol have remarkable effects.

The aforementioned complexing agents should be preferably water soluble inorganic salts containing sulfur and oxygen, and most preferably, thiosulfate and sulfite.

The reducing agents should be typically selected from organic thiourea based compounds and derivatives thereof. The thiourea based compounds should be preferably at least one selected from the group consisting of thiourea, N-methyl thiourea, 1-acetyl thiourea, 1,3-dimethyl thiourea, and ethylene thiourea.

The aforementioned gold ions should be primarily monovalent gold ions, though either monovalent or trivalent gold ions may be used, for the reason that an amount of the reducing agents to be used with monovalent gold ions is theoretically required to be only one third of the amount with trivalent gold ions.

BRIEF DESCRIPTION OF THE DRAWINGS

FIG. 9 shows characteristic curves indicating the relationship between a rate of gold deposition and a concentration of N-methyl thiourea as a reducing agent for each of the electroless gold plating solutions of the present invention using a reduction promoter and those of Comparative Examples using no reduction promoter.

DESCRIPTION OF PREFERRED EMBODIMENTS

The present invention will be described below in detail.

Instability of prior art electroless gold plating solutions may be in part attributed to reduction of gold ions with reaction products produced from the reducing agents in the solutions.

Figure 1:
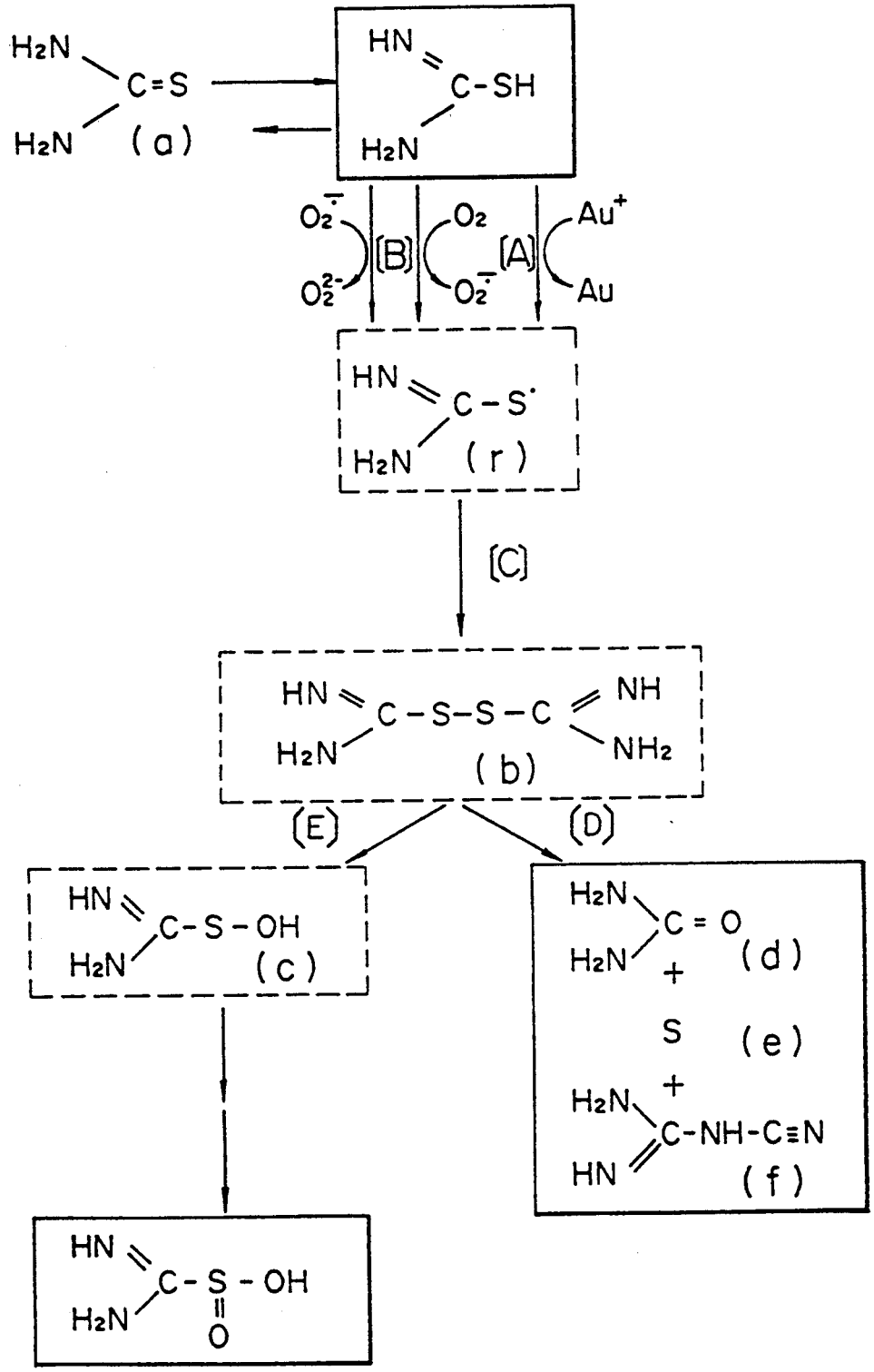
FIG. 1 shows a reaction scheme for illustrating a major reaction and a side reaction in the plating reaction when thiourea was added as a reducing agent.

For example, processes of a plating reaction and an oxidation reaction with oxygen when thiourea is used as a reducing agent are shown in FIG. 1. In the figure, the reaction process designated as [A] is a major reaction of the plating reaction, where thiourea reduces gold ions while the thiourea is converted through an oxidant (r) to an intermediate compound (b). Further the compound (b) is converted through a route [D] to final reaction products (d), (e) and (f). It has been confirmed that these compounds (d) to (f) do not reduce gold ions in the plating solutions, even if they accumulated. A portion of the intermediate compound (b) is converted through a route [E] to a final reaction product (h), formamidine sulfinic acid. This reaction product (h) has been confirmed to reduce gold ions in the solution even at a very small concentration of the product.

On the other hand, a route [B] represents a mechanism of the side oxidation reaction with oxygen where a reducing agent, thiourea (a) is converted to an oxidant (r) with oxygen being reduced, which oxidant dimerizes to produce an intermediate compound (b). Thus, the reaction is the same as the plating reaction, except that the species reduced by the thiourea is different from that in the plating reaction. As the concentration of the reducing agent is increased, therefore, a rate of plating is increased, and at the same time the side oxidation reaction of the reducing agent with oxygen is also accelerated causing precipitation of gold due to reduction of gold ions with the reaction products in the solution so that the stability of the solution is significantly impaired.

Figure 14:
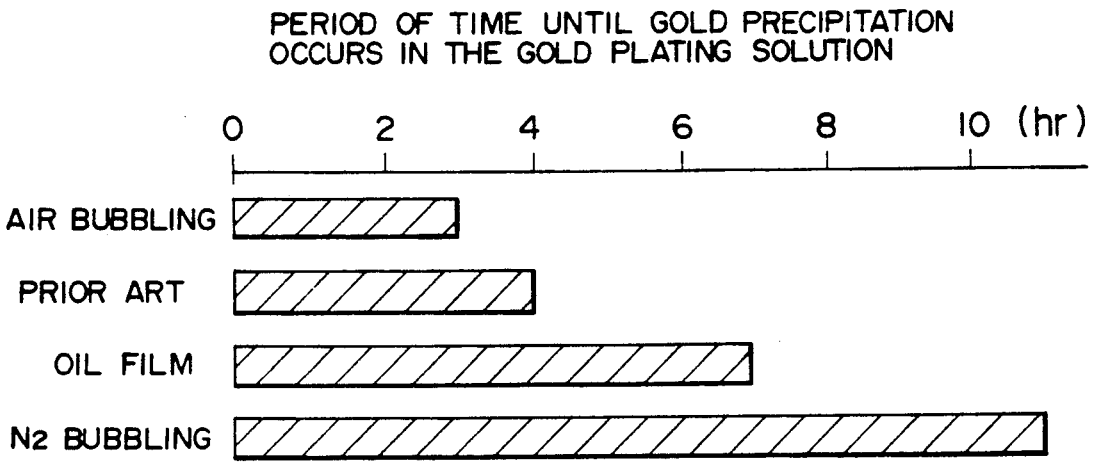
FIG. 14 shows the stability of an electroless gold plating solution under no loading in the oxygen-containing atmosphere.
Figure 15:
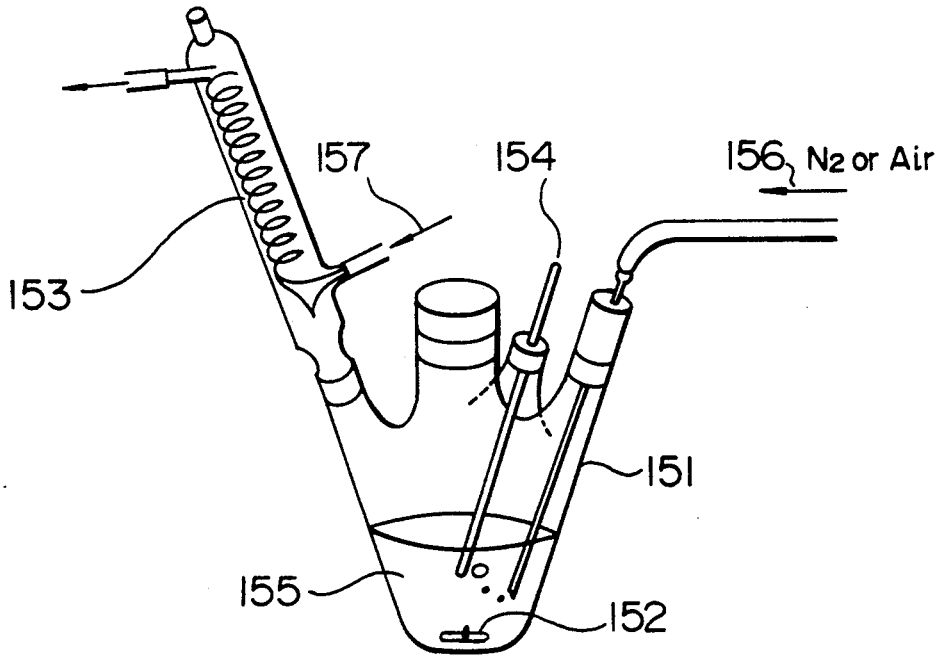
FIG. 15 shows a diagrammatical view of an apparatus employed for producing the results of FIG. 14.

An approach tried by the present inventors to remove physically oxygen so as to avoid the route [B] was to perform the plating reaction bubbling of nitrogen gas, and alternatively, while preventing the solution from contacting an external atmosphere by a saturated hydrocarbon oil film. The results obtained under no loading are shown in FIG. 14 where the abscissa represents a period of time until gold precipitation occurs. An apparatus for the experiments is shown in FIG. 15. FIG. 14 indicates the effects of oxygen on the stability of the plating solutions. The oil film and the nitrogen gas bubbling resulted in a relatively high stability, whereas air bubbling (air contains about 20% oxygen) reduced significantly the stability of the solutions. From this fact, it could be confirmed that oxygen has a great influence on the stability of the plating solutions.

In order to achieve an enhancement in the stability of the electroless gold plating solutions and an increase in the plating rate, however, only removal of oxygen is inefficient, because the plating reaction proceeding along the route [A] alone allows a portion of the intermediate produced from the reducing agent to convert along the route [E] resulting in the final product (h) which adversely affects the solutions. Therefore, the present inventors considered that such a reducing agent recycling process as inhibiting the reaction through the route [C] would be necessary.

Figure 2:
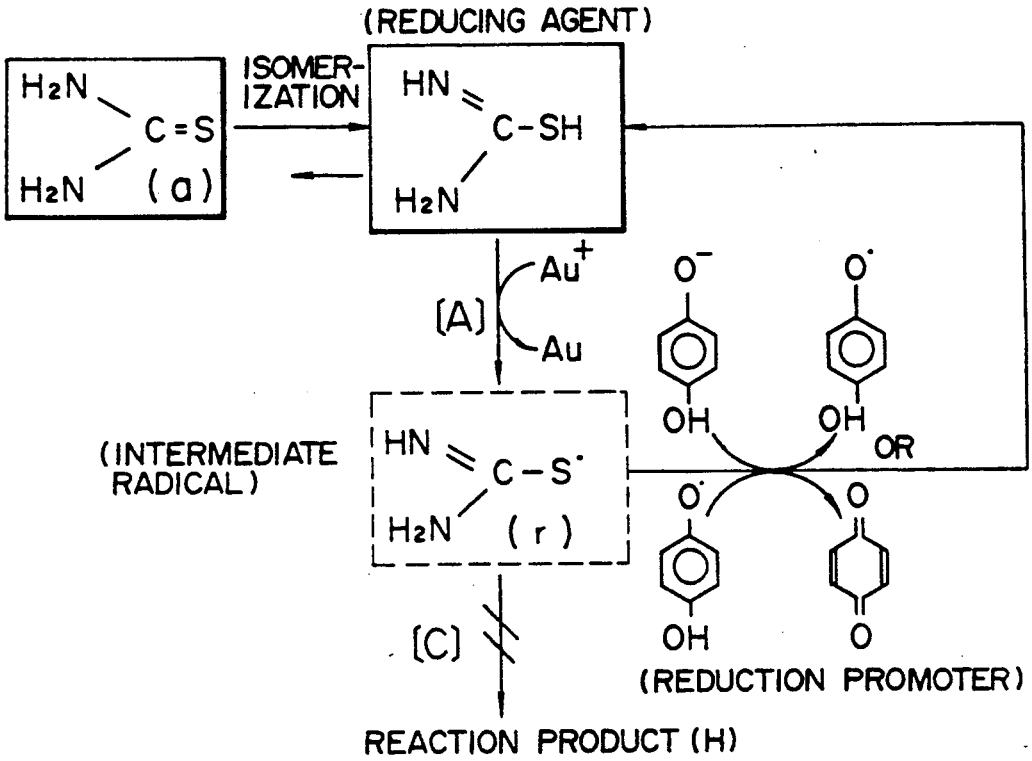
FIG. 2 shows a reaction scheme of the present invention for avoidance of the major reaction in the plating reaction when hydroquinone was added as a reduction promoter.
Figure 3:
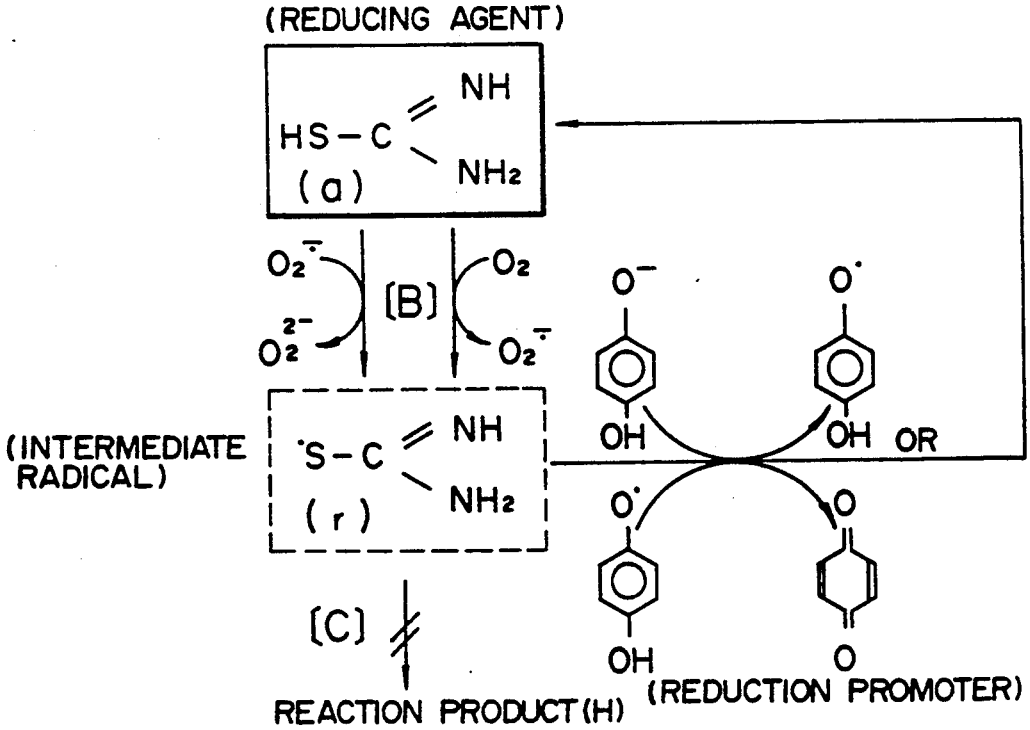
FIG. 3 shows a reaction scheme for avoidance of the side reaction in the plating reaction when hydroquinone was added as a reduction promoter.

The present inventors had an interest in the oxidant (r) and got an idea of adding a reduction promoter for changing the active oxidant (r) to a starting neutral reducing agent (a). It is important that the reduction promoter, for example, hydroquinone, should be water soluble, apt to release electrons, converted to inert reaction products, and incapable of reducing gold ions in the solution as described above. Although the reduction promoters have also an ability of causing gold plating, such is a secondary function. The primary function of the promoters is to reduce and restore the reaction intermediate produced from the reducing agent with gold ions being reduced to the original reducing agent. That is, the reduction promoters should be excellent in reactivity with the oxidant, but poor in reactivity with gold ions. Therefore, the reduction of gold ions should be mostly due to the action of the reducing agent. As can be seen from the reaction mechanisms shown in FIGS. 2 and 3, the reduction promoters are believed to function in the process where gold ions are reduced with thiourea which is converted to an oxidant (r), while a reduction promoter, hydroquinone gives electrons to the oxidant which is restored to the starting reducing agent (a) with the hydroquinone itself being converted to a stable oxidant. Therefore, even if either the primary reaction [A] or the secondary reaction [B] proceeds, the reaction does not proceed along the route [C], and the reducing agent is always recycled so that no reaction product (h) capable of reducing gold ions in the solution is produced, thereby enhancing the stability of the solution.

Figure 4:
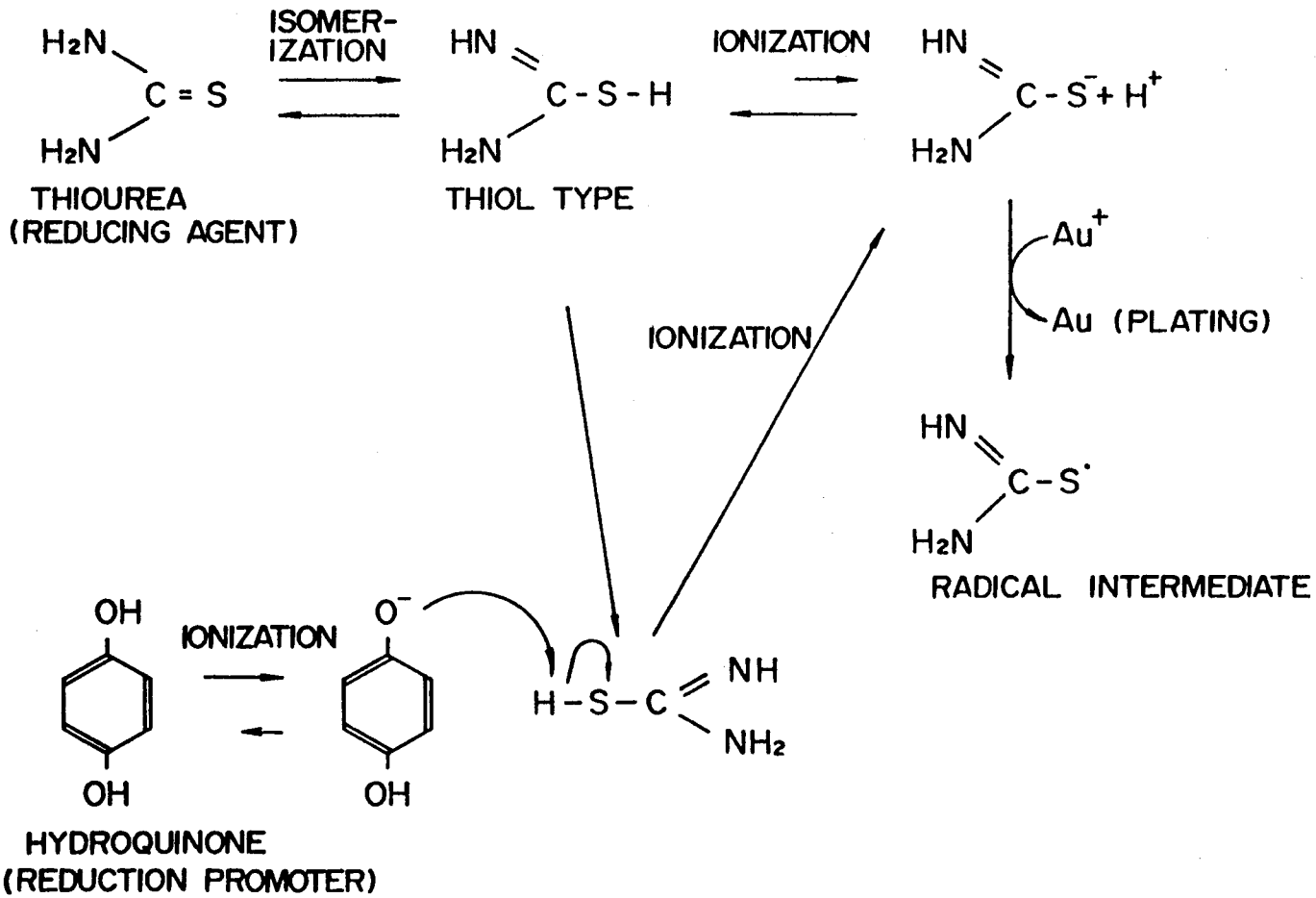
FIG. 4 shows a reaction scheme for explaining the relaxation of the rate-determinating step of the plating reaction owing to the addition of a reduction promoter.
Figure 5:
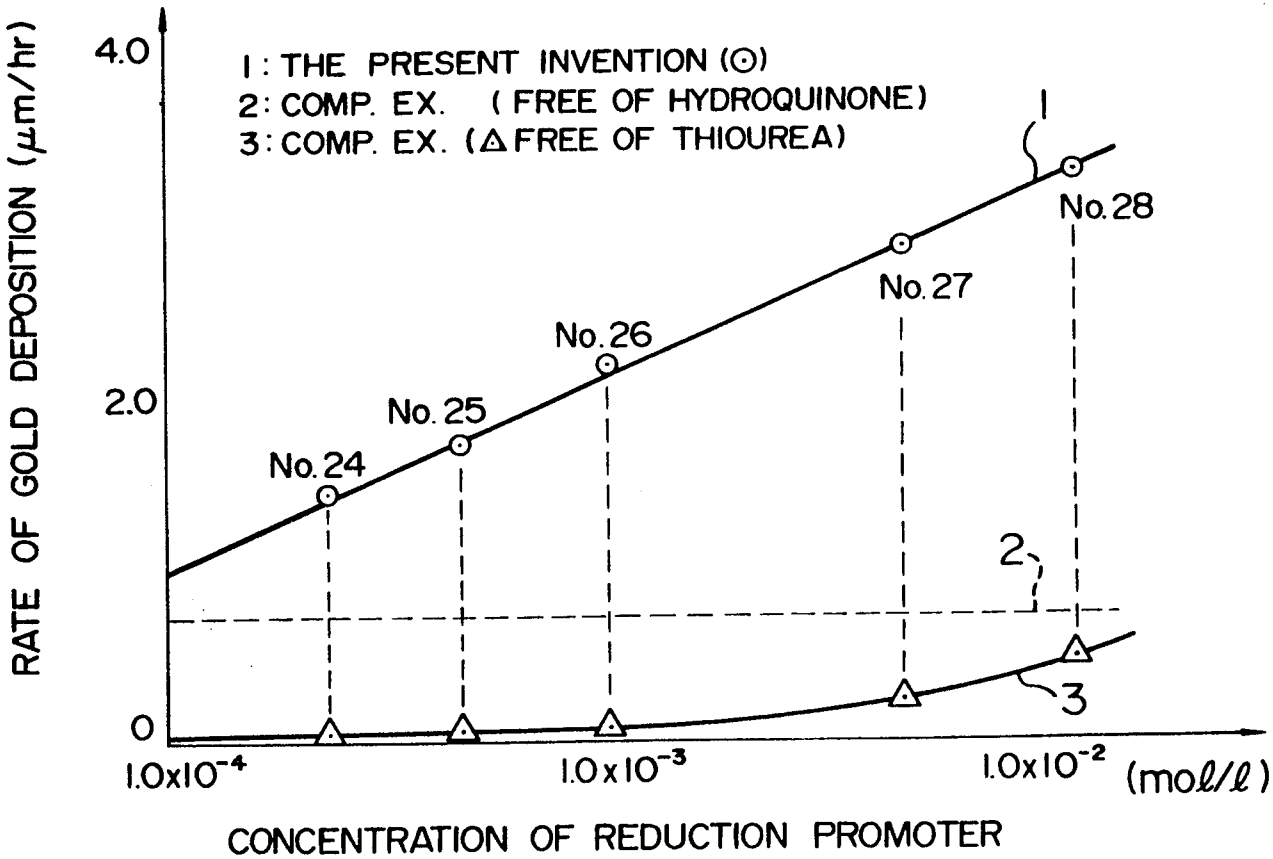
FIG. 5 shows characteristic curves indicating the relationship between a rate of gold deposition and a concentration of hydroquinone as a reduction promoter in accordance with the present invention, and those of Comparative Examples using no hydroquinone or no thiourea.

Furthermore, a higher plating rate as shown in FIG. 5 can be achieved as illustrated in Example 22 later. That is, the Figure shows characteristic curves representing the relationship between the gold deposition rate and the concentration of the reduction promoter (here hydroquinone) in solution, and it can be noted that an extraordinarily high deposition rate was obtained according to the present invention as shown in curve 1, comparing with Comparative Examples, curves 2 and 3. This can be explained with reference to FIG. 4 as follows: thiourea is in equilibrium with a thiol type in an aqueous solution. This thiol type is the ionic species which pertains directly to the reduction of gold ions, that is, the sulfur atoms become prone to release electrons allowing the plating reaction to proceed. It is believed, therefore, that the rate-determining step of the plating reaction lies in ionization of the reducing agents. One of the functions of the reduction promoters is to facilitate this ionization of the reducing agent. As the reduction promoters have a smaller pKa than the reducing agent, removal of protons from the thiol type of thiourea can be easily caused. As a result, the rate-determining step is relaxed to increase a concentration of ions of the reducing agent resulting in enhancement of the plating reaction. Thus, among various reduction promoters, those having a smaller pKa, such as hydroquinone and pyrogallol, have been used to achieve remarkable effects.

Practical examples of the electroless gold plating solutions as disclosed above will be described hereunder.

(1) Preparation of samples

Figure 6:
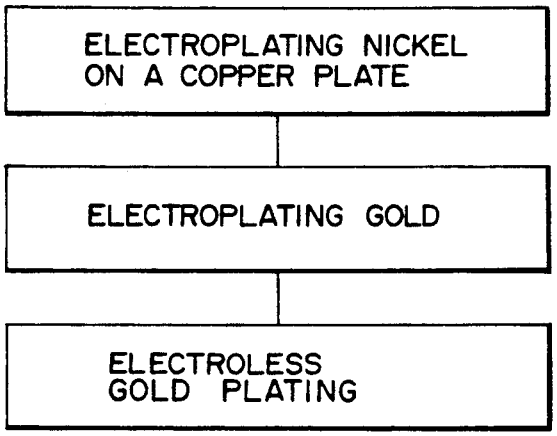
FIG. 6 shows a flow chart illustrating a process for preparing samples to be used in electroless gold plating.

A copper plate of 3.0 cm×3.0 cm in area and 0.3 mm in thickness was first coated with a nickel film of a thickness of 2 μm using a conventional nickel electroplating solution, and then coated with a gold film of a thickness of 1 μm using a conventional gold electroplating solution in accordance with the process shown in FIG. 6.

(2) Electroless plating treatment on samples

Samples were washed with a degreasing liquid, and then with a diluted hydrochloric acid, and rinsed with water. After the samples were dried by blowing nitrogen gas, they were weighed.

These samples were immersed for 3 hours in a plating solution having a composition as indicated in Examples 1 to 16 shown in Tables 1 to 4.

TABLE 1

| | | Comparative Example | | | Example | | | |
|---|---|---|---|---|---|---|---|---|
| | | 1 | 2 | 3 | 1 | 2 | 3 | 4 |
| Solution Composition | Sodium chloroaurate (III) (mol/l) | 0.005 | 0.012 | — | 0.012 | — | — | 0.030 |
| | Sodium gold (I) dithiosulfate (mol/l) | — | — | 0.050 | — | 0.20 | 0.080 | — |
| | Sodium thiosulfate (mol/l) | 0.05 | 0.10 | 0.90 | 0.25 | 0.10 | 0.50 | 0.10 |
| | Sodium sulfite (mol/l) | 0.80 | 0.40 | 0.05 | 0.40 | 0.15 | 0.60 | 0.40 |
| | * Thiourea (mol/l) | 0.10 | 0.033 | 0.00005 | 0.00066 | 0.0005 | 0.01 | 0.0053 |
| | * N-methyl thiourea (mol/l) | — | — | — | — | — | — | — |
| | ⊙ Hydroquinone (mol/l) | — | — | — | 0.09 | 0.01 | 0.0005 | 0.0045 |
| | ⊙ Pyrogallol (mol/l) | — | — | — | — | — | — | — |
| | Borax (mol/l) | 0.09 | 0.13 | 0.80 | 0.10 | — | — | 0.13 |
| | Ammonium chloride (mol/l) | — | — | — | — | 0.20 | 0.50 | — |
| Conditions | Solution temperature (°C.) | 70 | 80 | 90 | 80 | 80 | 70 | 80 |
| | pH | 7.5 | 9.0 | 11.0 | 9.0 | 7.5 | 9.0 | 8.0 |
| | Gold film thickness (μm/3 h) | 0.2 | 1.5 | 0.1 | 3.6 | 3.9 | 4.1 | 4.0 |
| | Gold film thickness using no reduction promoter (μm/3 h) | 0.2 | 1.5 | 0.1 | 2.3 | 0.1 | 0.2 | 0.2 |
| Solution decomposition period (under no loading) (hrs.) | | 4 | 12 | 6 | 90 | 100 | 100 | 120 |

TABLE 2

| | | Example | | | |
|---|---|---|---|---|---|
| | | 5 | 6 | 7 | 8 |
| Solution Composition | Sodium chloroaurate (III) (mol/l) | 0.001 | 0.200 | — | — |
| | Sodium gold (I) dithiosulfate (mol/l) | — | — | 0.050 | 0.20 |
| | Sodium thiosulfate (mol/l) | 0.90 | 0.50 | 0.25 | 0.50 |
| | Sodium sulfite (mol/l) | 0.01 | 0.05 | 0.40 | 0.80 |
| | * Thiourea (mol/l) | 0.090 | — | — | — |
| | * N-methyl thiourea (mol/l) | — | 0.0001 | 0.00066 | 0.090 |
| | ⊙ Hydroquinone (mol/l) | 0.0001 | — | — | — |
| | ⊙ Pyrogallol (mol/l) | — | 0.09 | 0.0045 | 0.0001 |
| | Borax (mol/l) | 0.09 | — | — | 1.0 |
| | Ammonium chloride (mol/l) | — | 0.20 | 0.09 | — |
| Conditions | Solution temperature (°C.) | 90 | 70 | 60 | 70 |
| | pH | 7.0 | 6.0 | 8.5 | 11.0 |
| | Gold film thickness (μm/3 h) | 2.0 | 1.8 | 0.9 | 0.5 |
| | Gold film thickness using no reduction promoter (μm/3 h) | 0.4 | 1.4 | 0.2 | 0.02 |
| Solution decomposition period (under no loading) (hrs.) | | 85 | 85 | 90 | 100 |

TABLE 3

| | | Example | | | | | |
|---|---|---|---|---|---|---|---|
| | | 9 | 10 | 11 | 12 | 13 | 14 |
| Solution Composition | Sodium chloroaurate (III) (mol/l) | 0.012 | — | 0.020 | — | 0.030 | — |
| | Sodium gold (I) | — | 0.010 | — | 0.03 | — | 0.050 |

TABLE 3-continued

| | | Example | | | | | |
|---|---|---|---|---|---|---|---|
| | | 9 | 10 | 11 | 12 | 13 | 14 |
| | dithiosulfate (mol/l) | | | | | | |
| | Sodium thiosulfate (mol/l) | 0.15 | 0.10 | 0.10 | 0.50 | 0.30 | 0.25 |
| | Sodium sulfite (mol/l) | 0.40 | 0.60 | 0.25 | 0.15 | 0.01 | 0.40 |
| | * 1-acetyl thiourea (mol/l) | 0.00066 | 0.0005 | 0.0001 | 0.01 | 0.09 | — |
| | * 1,3-dimethylthiourea (mol/l) | — | — | — | — | — | 0.0001 |
| | ◎ p-phenylenediamine (mol/l) | 0.09 | 0.01 | 0.0035 | 0.0005 | 0.0001 | — |
| | ◎ p-aminophenol (mol/l) | — | — | — | — | — | 0.0035 |
| | Borax (mol/l) | 0.09 | 0.20 | 0.30 | 0.50 | 1.0 | — |
| | Ammonium chloride (mol/l) | — | — | — | — | — | 0.30 |
| Conditions | Solution temperature (°C.) | 80 | 70 | 80 | 70 | 70 | 70 |
| | pH | 8.5 | 9.0 | 7.5 | 7.5 | 8.0 | 11.0 |
| | Gold film thickness (μm/3 h) | 3.3 | 2.9 | 2.7 | 3.7 | 1.6 | 1.5 |
| | Gold film thickness using no reduction promotor (μm/3 h) | 0.2 | 0.2 | 0.2 | 0.4 | 0.9 | 0.2 |
| Solution decomposition period (under no loading) (hrs.) | | 90 | 80 | 90 | 90 | 80 | 60 |

TABLE 4

| | | Example | |
|---|---|---|---|
| | | 15 | 16 |
| Solution Composition | Sodium chloroaurate III (mol/l) | — | — |
| | Sodium gold (I) dithiosulfate (mol/l) | 0.001 | 0.2 |
| | Sodium thiosulfate (mol/l) | 0.90 | 0.01 |
| | Sodium sulfite (mol/l) | 0.60 | 0.80 |
| | * 1-acetyl thiourea (mol/l) | — | — |
| | * 1,3-dimethylthiourea (mol/l) | 0.00066 | 0.09 |
| | ◎ p-phenylenediamine (mol/l) | — | — |
| | ◎ p-aminophenol (mol/l) | 0.09 | 0.0001 |
| | Borax (mol/l) | — | — |
| | Ammonium chloride (mol/l) | 0.1 | 0.09 |
| Conditions | Solution temperature (°C.) | 90 | 60 |
| | pH | 6.0 | 9.0 |
| | Gold film thickness (μm/3 h) | 1.8 | 1.9 |
| | Gold film thickness using no reduction promoter (prior art) (μm/3 h) | 0.2 | 0.3 |
| Solution decomposition period (under no loading) (hrs.) | | 80 | 70 |

The thickness of gold films after 3 hours was measured by a gravimetric method. In order to evaluate the stability of the electroless gold plating solutions containing a reduction promoter of the present invention, a period of time until a precipitation of gold occurred (solution decomposition period) was determined. The temperature (solution temperature) and pH of plating solutions are also indicated in each of the Tables. In the column of solution composition, the marks * and ◎ designate a reducing agent and a reduction promoter, respectively. These tables indicate also gold film thicknesses using no reduction promoter as Comparative Examples which had the same composition as that of the plating solution in Examples 1 to 16, except that no reduction promoter marked with ◎ was used. With any one of the plating solutions in Examples 1 to 16, deposited gold films were clear yellow in color, and no precipitation was observed in the solutions.

It could be concluded from the results indicated in these tables that the gold films in the case of addition of the reduction promoters had a larger thickness as compared with those in Comparative Examples using no reduction promoter, and that the plating solutions containing any one of the reduction promoters were much more stable than the prior art plating solutions.

EXAMPLE 17

In order to study the effects of the reduction promoters (marked with ◎), each of the samples prepared in the same way as in the aforementioned Examples was immersed for one hour in each of the electroless plating solutions Nos. 1 to 4 of the present invention with varying concentrations of thiourea as reducing agent (marked with *).

The composition of the plating solution and plating conditions;

| | | |
|---|---|---|
| | Sodium chloroaurate (III) | 0.012 mol/l |
| | Sodium thiosulfate | 0.1 mol/l |
| ◎ | Hydroquinone | 0.00027 mol/l |
| | Sodium sulfate | 0.4 mol/l |
| | Borax | 0.13 mol/l |
| | Solution temperature | 80° C. |
| | pH | 9.0 |
| | Relative to the above composition, * thiourea: | |
| | No. 1 | 0.0025 mol/l |
| | No. 2 | 0.0066 mol/l |
| | No. 3 | 0.0164 mol/l |
| | No. 4 | 0.0328 mol/l |

Figure 7:
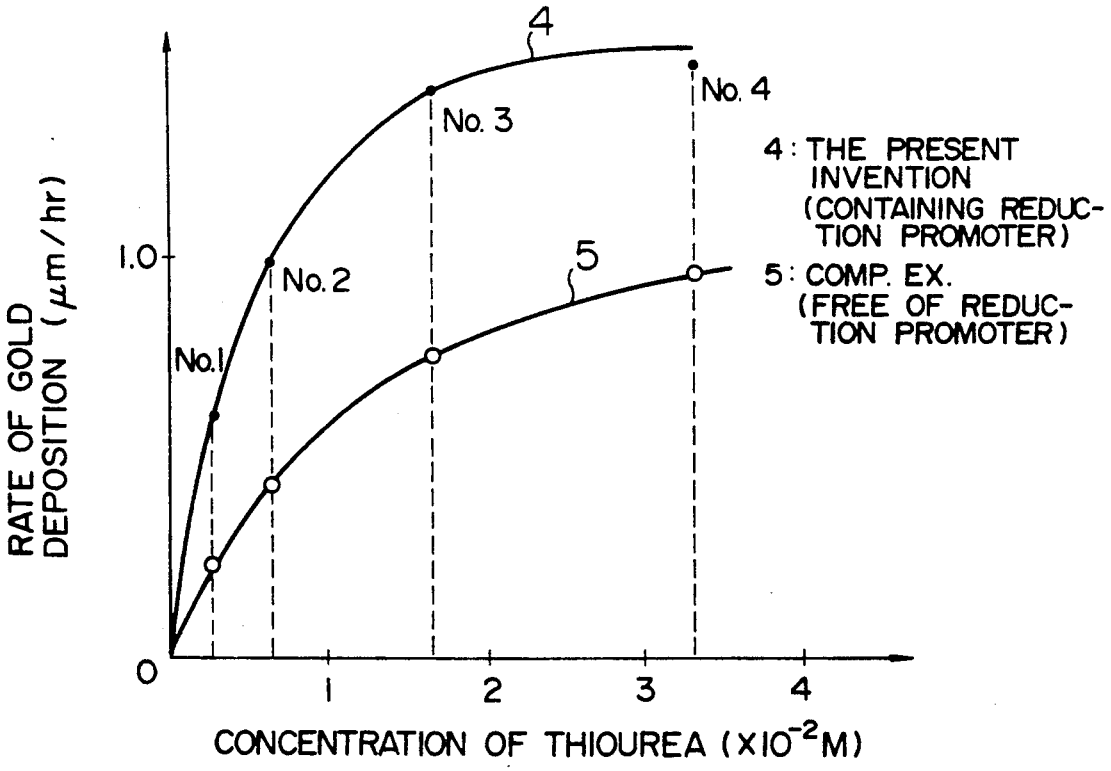
FIG. 7 shows characteristic curves indicating the relationship between a rate of gold deposition and a concentration of thiourea as a reducing agent for each of the electroless gold plating solutions of the present invention using a reduction promoter and those of Comparative Examples using no reduction promoter.

The thickness of the gold films deposited after one hour from each plating solution as above under forced stirring was evaluated by a gravimetric method. With the plating solutions containing no reduction promoter, similar measurements were conducted. The results are shown in FIG. 7. In the Figure, curves 4 and 5 were plotted from the results in the example containing a reduction promoter of the present invention and Comparative Example, respectively.

EXAMPLE 18

For the same purpose as in Example 17, each of the samples prepared in the same way as in the forementioned Examples was immersed for one hour in each of the electroless plating solutions Nos. 5 to 9 of the present invention with varying concentrations of 1-acetyl thiourea.

The composition of the plating solution and plating conditions:

| | |
|---|---|
| Sodium chloroaurate (III) | 0.012 mol/l |
| Sodium thiosulfate | 0.1 mol/l |

-continued

| | |
|---|---|
| ◎ Hydroquinone | 0.00027 mol/l |
| Sodium sulfite | 0.4 mol/l |
| Borax | 0.13 mol/l |
| Solution temperature | 80° C. |
| pH | 9.0 |
| Relative to the above composition, * 1-acetyl thiourea: | |
| No. 5 | 0.0025 mol/l |
| No. 6 | 0.0066 mol/l |
| No. 7 | 0.0164 mol/l |
| No. 8 | 0.0328 mol/l |
| No. 9 | 0.0493 mol/l |

Figure 8:
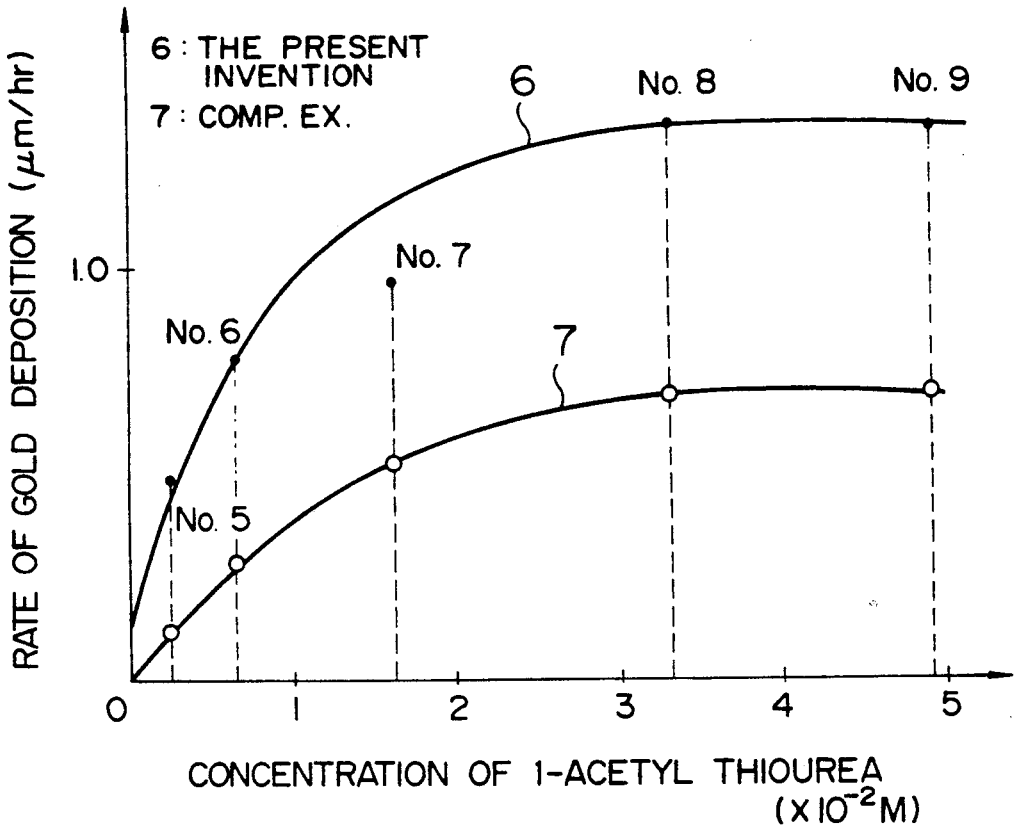

The thickness of the gold films deposited after one hour from each plating solution as above under forced stirring was evaluated by the gravimetric method. With the plating solutions containing no reduction promoter of hydroquinone, similar measurements were conducted as comparative experiments. The results are shown in FIG. 8. In the invention and those of the comparative experiments, respectively.

EXAMPLE 19

For the same purpose as in Example 17, each of the samples prepared in the same way as in the aforementioned Examples was immersed for one hour in each of the electroless plating solutions Nos. 10 to 14 of the present invention with varying concentrations of N-methyl thiourea.

The composition of the plating solution and plating conditions:

| | |
|---|---|
| Sodium chloroaurate (III) | 0.012 mol/l |
| Sodium thiosulfate | 0.1 mol/l |
| ◎ Hydroquinone | 0.00027 mol/l |
| Sodium sulfite | 0.4 mol/l |
| Borax | 0.13 mol/l |
| Solution temperature | 80° C. |
| pH | 9.0 |
| Relative to the above composition, * N-methyl thiourea: | |
| No. 10 | 0.0025 mol/l |
| No. 11 | 0.0066 mol/l |
| No. 12 | 0.0164 mol/l |
| No. 13 | 0.0328 mol/l |
| No. 14 | 0.0493 mol/l |

Figure 9:
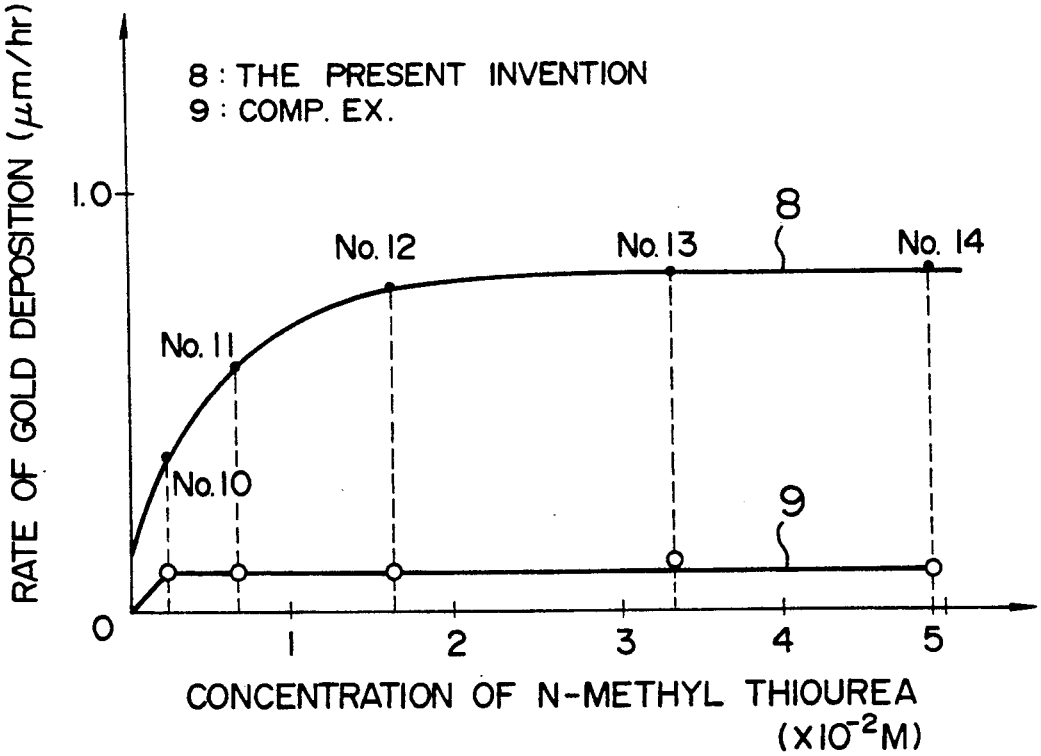
FIG. 9 shows characteristic curves indicating the relationship between a rate of gold deposition and a concentration of 1-acetyl thiourea as a reducing agent for each of the electroless gold plating solutions of the present invention using a reduction promoter and those of Comparative Examples using no reduction promoter.

The thickness of the gold films deposited after one hour from each plating solution as above under forced stirring was evaluated by the gravimetric method. With the plating solutions containing no reduction promoter of hydroquinone, similar measurements were conducted as comparative experiments. The results are shown in FIG. 9. In the Figure, curves 8 and 9 indicate the results of the present invention and those of the comparative experiments, respectively.

EXAMPLE 20

For the same purpose as in Example 17, each of the samples prepared in the same way as in the aforementioned Examples was immersed for one hour in each of the electroless plating solutions Nos. 15 to 18 of the present invention with varying concentrations of ethylene thiourea.

The composition of the plating solution and plating conditions:

| | |
|---|---|
| Sodium chloroaurate (III) | 0.012 mol/l |
| Sodium thiosulfate | 0.1 mol/l |
| ◎ Hydroquinone | 0.00027 mol/l |

-continued

| | |
|---|---|
| Sodium sulfite | 0.4 mol/l |
| Borax | 0.13 mol/l |
| Solution temperature | 80° C. |
| pH | 9.0 |
| Relative to the above composition, * ethylene thiourea: | |
| No. 15 | 0.0025 mol/l |
| No. 16 | 0.0066 mol/l |
| No. 17 | 0.0328 mol/l |
| No. 18 | 0.0493 mol/l |

Figure 10:
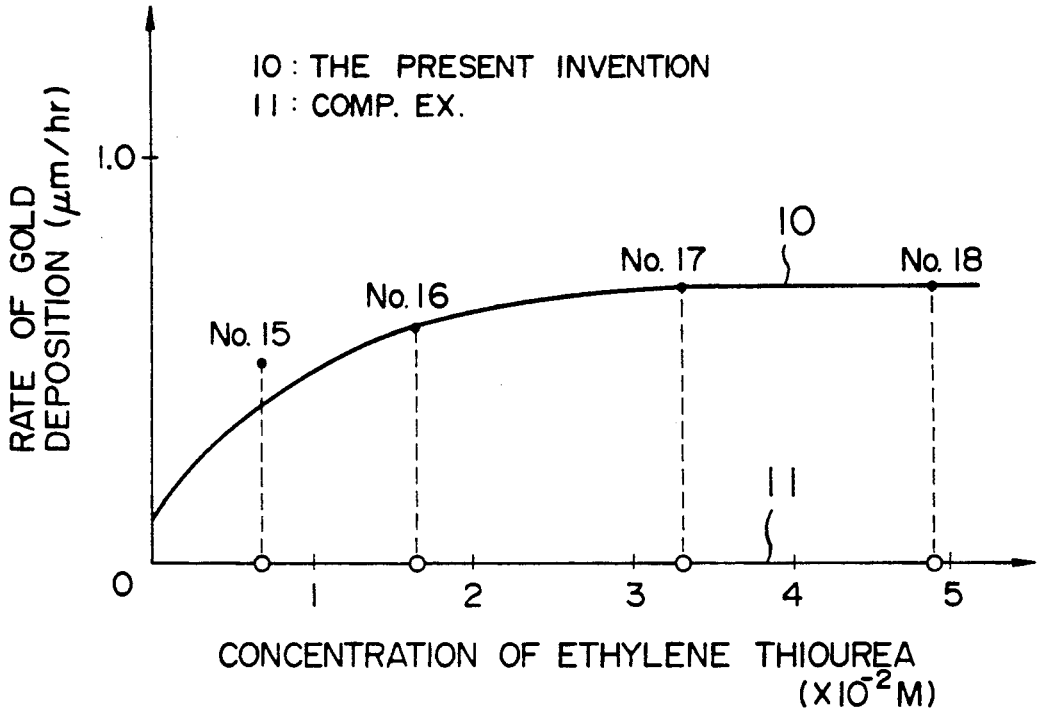
FIG. 10 shows characteristic curves indicating the relationship between a rate of gold deposition and a concentration of ethylene thiourea as a reducing agent for each of the electroless gold plating solutions of the present invention using a reduction promoter and those of Comparative Examples using no reduction promoter.

The thickness of the gold films deposited after one hour from each plating solution as above under forced stirring was evaluated by the gravimetric method. With the plating solutions containing no reduction promoter of hydroquinone, similar measurements were conducted as comparative experiments. The results are shown in FIG. 10. In the Figure, curves 10 and 11 indicate the results of the present invention and those of the comparative experiments, respectively.

EXAMPLE 21

For the same purpose as in Example 17, each of the samples prepared in the same way as in the aforementioned Examples was immersed for one hour in each of the electroless plating solutions Nos. 19 to 23 of the present invention with varying concentrations of 1-dimethyl thiourea.

The composition of the plating solution and plating conditions:

| | |
|---|---|
| Sodium chloroaurate (III) | 0.012 mol/l |
| Sodium thiosulfate | 0.1 mol/l |
| ◎ Hydroquinone | 0.00027 mol/l |
| Sodium sulfite | 0.4 mol/l |
| Borax | 0.13 mol/l |
| Solution temperature | 80° C. |
| pH | 9.0 |
| Relative to the above composition, * 1,3-dimethyl thiourea: | |
| No. 19 | 0.0025 mol/l |
| No. 20 | 0.0066 mol/l |
| No. 21 | 0.0164 mol/l |
| No. 22 | 0.0328 mol/l |
| No. 23 | 0.0493 mol/l |

Figure 11:
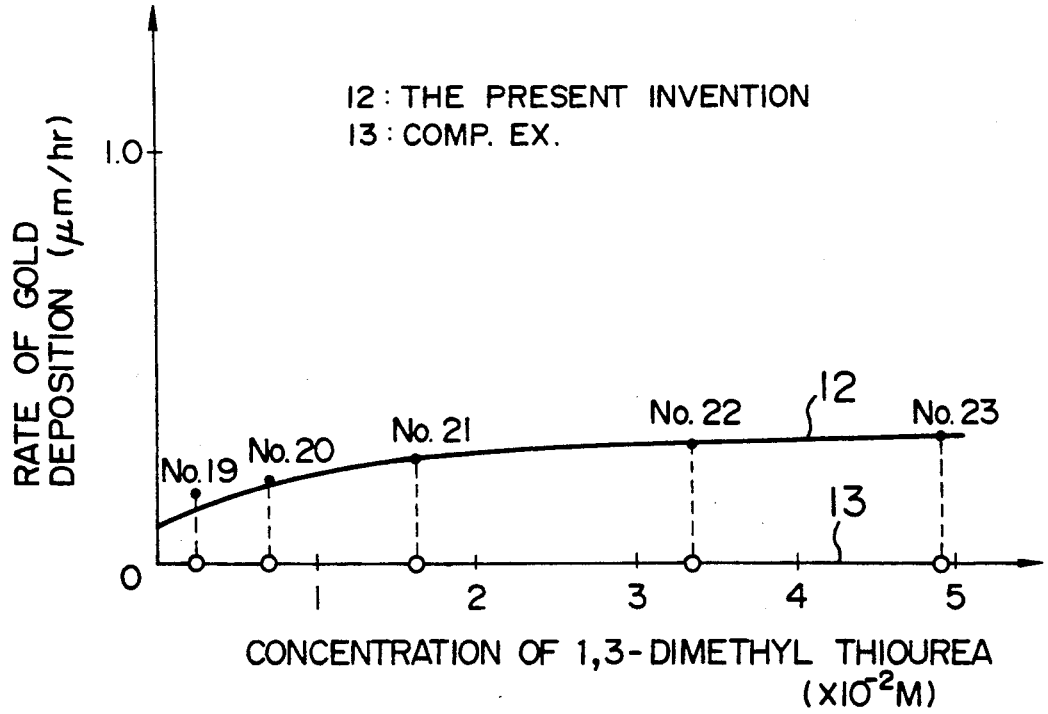
FIG. 11 shows characteristic curves indicating the relationship between a rate of gold deposition and a concentration of 1,3-dimethyl thiourea as a reducing agent for each of the electroless gold plating solutions of the present invention using a reduction promoter and those of Comparative Examples using no reduction promoter.

The thickness of the gold films deposited after one hour from each plating solution as above under forced stirring was evaluated by the gravimetric method. With the plating solutions containing no reduction promoter of hydroquinone, similar measurements were conducted as comparative experiments. The results are shown in FIG. 11. In the Figure, curves 12 and 13 represent the results of the present invention and those of the comparative experiments, respectively.

With any one of the plating solutions of Examples 17 to 21, the deposited gold films were clear yellow in color, and no precipitation was observed in the solutions.

EXAMPLE 22

Each of the samples prepared in the same way as in the aforementioned Examples was immersed for one hour under indicated conditions in each of the electroless plating solutions Nos. 24 to 28 having the indicated compositions of the present invention.

The composition of the plating solution and plating conditions:

| | |
|---|---|
| Sodium chloroaurate (III) | 0.012 mol/l |
| Sodium thiosulfate | 0.1 mol/l |
| * Thiourea | 0.016 mol/l |
| Sodium sulfite | 0.4 mol/l |
| Borax | 0.13 mol/l |
| Solution temperature | 80° C. |
| pH | 9.0 |
| Relative to the above composition, * ⊙ hydroquinone: | |
| No. 24 | 0.00023 mol/l |
| No. 25 | 0.00046 mol/l |
| No. 26 | 0.0010 mol/l |
| No. 27 | 0.0046 mol/l |
| No. 28 | 0.014 mol/l |

The thickness of the gold films deposited after one hour from each plating solution as above under forced stirring was evaluated by the gravimetric method. With the plating solutions containing no thiourea, similar measurements were conducted as comparative experiments. The results are shown in FIG. 5. In the Figure, curve 1 represents the results of the present invention, curve 2 the comparative experiment containing no ⊙ hydroquinone (reduction promoter), and curve 3 the a comparative experiment containing no * thiourea (reducing agent). It is apparent from the results that the present invention could achieve a gold depositing rate 2 to 3 times as large as that of the prior art.

EXAMPLE 23

Each of the samples prepared in the same way as in the aforementioned Examples was immersed for one hour under indicated conditions in each of the electroless plating solutions Nos. 29 to 31 having the indicated composition of the present invention.

Composition of the plating solution and plating conditions:

| | |
|---|---|
| Sodium chloroaurate (III) | 0.012 mol/l |
| Sodium thiosulfate | 0.1 mol/l |
| * Thiourea | 0.016 mol/l |
| Sodium sulfite | 0.4 mol/l |
| Borax | 0.13 mol/l |
| Solution temperature | 80° C. |
| pH | 9.0 |
| Relative to the above composition, ⊙ pyrogallol: | |
| No. 29 | 0.00023 mol/l |
| No. 30 | 0.0046 mol/l |
| No. 31 | 0.010 mol/l |

Figure 12:
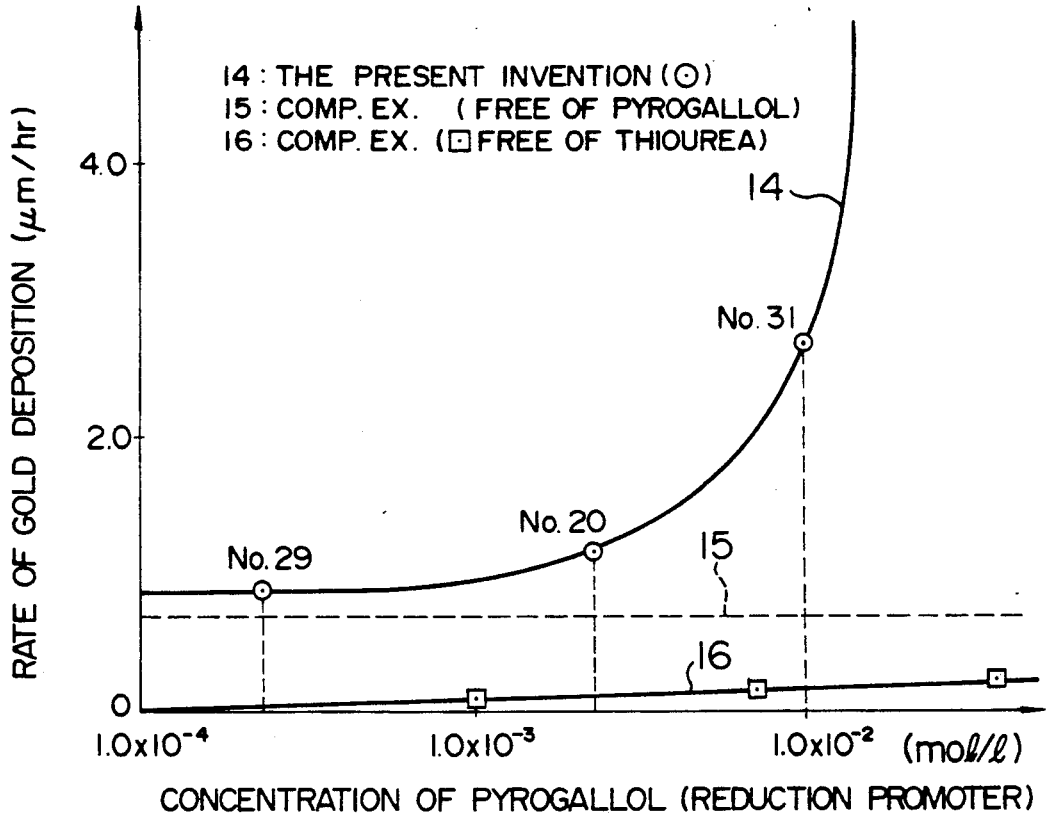
FIG. 12 shows characteristic curves indicating the relationship between a rate of gold deposition and a concentration of pyrogallol in accordance with the present invention, as compared with those of Comparative Examples using no pyrogallol or no thiourea.

The thickness of the gold films deposited after one hour from each plating solution as described above under forced stirring was evaluated by the gravimetric method. The deposited gold films were clear yellow in color, and no precipitation was observed in the solutions. The results of the measurements are shown in FIG. 12. In the Figure, curve 14 represents the results of the present invention, curve 15 the comparative experiment containing no ⊙ pyrogallol (reduction promoter), and curve 15 the a comparative experiment containing no * thiourea (reducing agent). Even with no thiourea being added, the use of 0.039 mol/1 pyrogallol led to a gold deposition rate of 0.23 μm/hr.

EXAMPLE 24

Each of the samples prepared in the same way as in the aforementioned Examples was immersed for one hour under indicated conditions in each of the electroless plating solutions Nos. 32 to 34 having the indicated composition of the present invention.

The composition of the plating solution and plating conditions:

| | |
|---|---|
| Sodium chloroaurate (III) | 0.012 mol/l |
| Sodium thiosulfate | 0.1 mol/l |
| * Thiourea | 0.016 mol/l |
| Sodium sulfite | 0.4 mol/l |
| Borax | 0.13 mol/l |
| Solution temperature | 80° C |
| PH | 9.0 |
| Relative to the above composition, ⊙ catechol: | |
| No. 32 | 0.00023 mol/l |
| No. 33 | 0.0046 mol/l |
| No. 34 | 0.023 mol/l |

Figure 13:
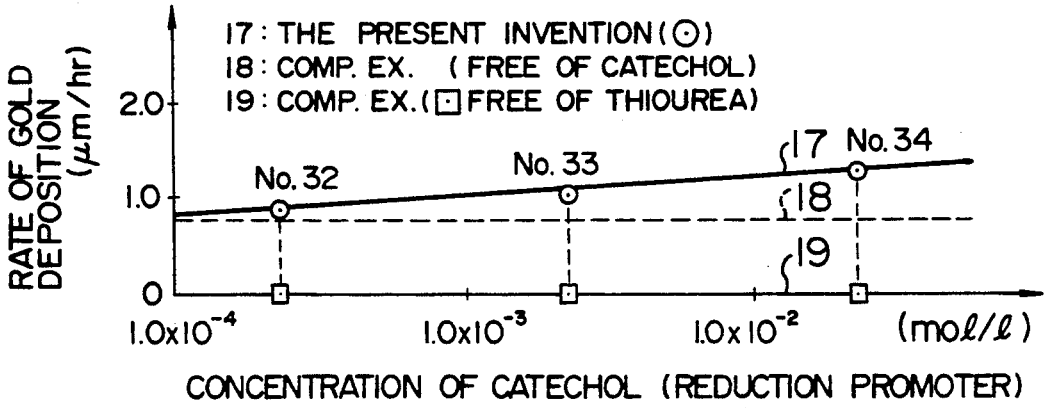
FIG. 13 shows characteristic curves indicating the relationship between a rate of gold deposition and a concentration of catechol in accordance with the present invention, as compared with those of Comparative Examples using no catechol or no thiourea.

The thickness of the gold films deposited after one hour from each plating solution as described above under forced stirring was evaluated by the gravimetric method. The deposited gold films were lusterless and clear yellow in color, and no precipitation was observed in the solutions. The results of the measurements are shown in FIG. 13. In the Figure, curve 17 represents the results of the present invention, curve 18 the comparative experiment containing no ⊙ catechol (reduction promoter), and curve 19 the a comparative experiment containing no * thiourea (reducing agent).

EXAMPLE 25

Each of the samples prepared in the same way as in the aforementioned Examples was immersed for one hour under indicated conditions in each of the electroless plating solutions Nos. 35 to 37 having the indicated composition of the present invention.

The composition of the plating solution and plating conditions:

| | |
|---|---|
| Sodium chloroaurate (III) | 0.012 mol/l |
| Sodium thiosulfate | 0.1 mol/l |
| * Thiourea | 0.016 mol/l |
| Sodium sulfite | 0.4 mol/l |
| Borax | 0.13 mol/l |
| Solution temperature | 80° C. |
| pH | 9.0 |
| Relative to the above composition, ⊙ methyl hydroquinone: | |
| No. 35 | 0.00023 mol/l |
| No. 36 | 0.0046 mol/l |
| No. 37 | 0.023 mol/l |

The thickness of the gold films deposited after one hour from each plating solution as described above under forced stirring was evaluated by the gravimetric method. The deposited gold films were lusterless and clear yellow in color, and no precipitation was observed in the solutions.

From the Examples as described above, the followings may be concluded:

The addition of the reduction promoters to the plating solutions allows the restoration of reaction intermediates, which have been produced from the reducing agents after reducing gold ions, to the original reducing agents so that the reducing agents are always recycled and no reaction product capable of reducing gold ions is produced. Therefore, the stability of the solutions has been enhanced.

As the reduction promoters have a smaller pKa than those of the reducing agents, removal of protons from the reducing agents is effected to increase the concentration of ions of the reducing agents. The increase of the concentration of ions of the reducing agents leads to an increase in the plating rate, because the ionization of the reducing agents is the rate-determining step.

In order to ensure that the reduction promoters are soluble in the plating solutions and inert after the reaction was conducted, they must have a benzene ring and a hydrophilic substituent as $R_1$ of either hydroxyl or amino group. Moreover, in order to inhibit an addition reaction to the benzene ring, the substituents $R_2$ to $R_4$ should preferably have a substituent introduced. For preserving the solubility in the plating solutions, $R_2$ to $R_4$ should be selected from the group consisting of hydroxyl group, amino group, hydrogen atom, halide group, methoxy group, and alkyl group. If the aforementioned alkyl group is at least one of methyl, ethyl, and t-butyl groups, the solubility in the plating solutions can be maintained.

As gold ions are cationic, requisite complexing agent must be anionic. Water soluble inorganic salts containing sulfur and oxygen atoms having a larger electronegativity, above all, are excellent as complexing agents.

Among the aforementioned water soluble inorganic salts, thiosulfates and sulfites are stable compounds.

A preferred thiourea based organic compound as a reducing agent is one selected from the group consisting of thiourea, N-methyl thiourea, 1-acetyl thiourea 1,3-dimethyl thiourea, and ethylene thiourea which are soluble in the plating solutions.

The use of monovalent gold ions is more economical than trivalent gold ions, because the amount of the reducing agents to be used for monovalent an amount of the reducing agents to be used for monovalent gold ions is theoretically required to be only one third of that for trivalent gold.

The electroless gold plating reaction is a catalytic reaction so that simply upon bringing substrates in contact with gold ions in the plating solutions, the plating reaction can proceed.

Substrates to be plated should be pretreated by applying coating films of gold or a metal having a lower ionization tendency than that of gold in a pattern where the electroless gold plating is required to be effected. This is for preventing a substituting reaction with coating metals in the pattern on the substrates. Moreover, in order to avoid a dissolution of foreign metals into the gold plating solutions in advance, the substrates should be preferably coated with the same metal to be plated, i.e., gold.

The gold coating pattern as above is formed thin, which can be accomplished by gold-substituting deposition. The gold-substituting deposition may be performed by first forming a prime metal pattern with a metal having a higher ionization tendency than that of gold, and then forming the gold coating pattern by selectively depositing gold through substitution reaction on the prime metal pattern.

If pH is lower than 6.0, the rate of the plating reaction is reduced, and if it is higher than 11.0, gold precipitation occurs in the plating solutions.

What is claimed is:

1. An electroless gold plating solution comprising gold ions, a complexing agent, a reducing agent and a reduction promoter which has a function of giving electrons to an active oxidant produced from oxidation of said reducing agent when said reducing agent reduces said gold ions, to restore said active oxidant to the original reducing agent and to form a stable oxidant from said reduction promoter.

2. The electroless gold plating solution according to claim 1, in which said reduction promoter comprises a compound represented by the general formula:

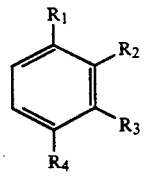

where $R_1$ represents either a hydroxyl group or an amino group, and each of $R_2$, $R_3$, and $R_4$ represents independently one member selected from the group consisting of hydroxyl, amino, hydrogen, halogen, methoxy, and alkyl groups.

3. The electroless gold plating solution according to claim 2, in which said alkyl group is selected from the group consisting of methyl, ethyl, and t-butyl groups.

4. The electroless gold plating solution according to claim 1 in which said complexing agent is selected from the group consisting of water soluble inorganic salts containing sulfur and oxygen.

5. The electroless gold plating solution according to claim 4, in which said water soluble inorganic salts containing sulfur and oxygen comprises thiosulfate or sulfite.

6. The electroless gold plating solution according to claim 1, in which said reducing agent is selected from the group consisting of thiourea based organic compounds and derivatives thereof.

7. The electroless gold plating solution according to claim 6, in which said thiourea based organic compound is selected from the group consisting of thiourea, N-methyl thiourea, 1-acetyl thiourea, 1,3-dimethyl thiourea and ethylene thiourea.

8. The electroless gold plating solution according to claim 1, in which said gold ions comprise predominantly monovalent gold ions.

9. A process for conducting electroless gold plating by bringing a substrate into contact with an electroless gold plating solution comprising gold ions, a complexing agent, a reducing agent, and a reduction promoter which has a function of giving electrons to an oxidant, said oxidant being produced from oxidation of said reducing agent with said gold ions being reduced, to restore said oxidant to the original reducing agent.

10. The process for conducting electroless gold plating according to claim 9, further comprising a step of pre-forming a pattern of gold coating film on said substrate to be plated, and effecting selectively electroless gold plating on said pattern of gold coating film.

11. The process for conducting electroless gold plating according to claim 10, further comprising a step of forming a prime metal pattern of a metal having a higher ionization tendency, and then effecting selectively gold deposition on said pattern by substituting gold for said metal to form a pattern of gold coating film.

12. The process for conducting electroless gold plating according to claim 9, which pH of said electroless gold plating solution is controlled in the range of 6.0 to 11.0 during plating.

13. The electroless gold plating solution according to claim 2 in which said complexing agent is a water inorganic salt containing sulphur and oxygen and said reducing agent is a thiourea based organic compound selected from the group consisting of thiourea, N-methyl thiourea, 1-acetyl thiourea, 1,3-dimethyl thiourea and ethylene thiourea.

14. The electroless gold plating solution according to claim 13, wherein said reduction promoter is hydroquinone or pyrogallol.

* * * * *